US005720344A

United States Patent [19]

Newman

[11] Patent Number: 5,720,344

[45] Date of Patent: Feb. 24, 1998

[54] METHOD OF LONGITUDINALLY SPLITTING A PIPE COUPLING WITHIN A WELLBORE

[76] Inventor: Frederic M. Newman, 1618 W. Dengar, Midland, Tex. 79705

[21] Appl. No.: 734,355

[22] Filed: Oct. 21, 1996

[51] Int. Cl.[6] ..... E21B 29/02

[52] U.S. Cl. ..... 166/253.1; 166/66.5; 166/255.2; 166/297; 166/376

[58] Field of Search ..... 166/55, 55.1, 66, 166/66.5, 98, 253.1, 255.1, 255.2, 297, 301, 376

[56] References Cited

U.S. PATENT DOCUMENTS

| | | | |
|---|---|---|---|
| 2,037,955 | 4/1936 | Wells . | |
| 2,305,261 | 12/1942 | Kinley . | |
| 2,407,991 | 9/1946 | McCullough . | |
| 2,587,244 | 2/1952 | Sweetman . | |
| 2,605,704 | 8/1952 | Dumas . | |
| 2,758,543 | 8/1956 | Grandin . | |
| 2,761,384 | 9/1956 | Sweetman . | |
| 3,032,107 | 5/1962 | Rumble et al. | 166/66.5 X |
| 3,165,153 | 1/1965 | Lanmon | 166/255.2 X |
| 3,182,724 | 5/1965 | Shore | 166/66.5 X |
| 3,491,830 | 1/1970 | Sweetman | 166/301 X |
| 3,734,018 | 5/1973 | Gillingham . | |
| 3,964,553 | 6/1976 | Basham et al. | 166/66.5 |
| 4,438,810 | 3/1984 | Wilkinson | 166/66.5 |
| 4,498,367 | 2/1985 | Skolnick et al. . | |
| 4,537,255 | 8/1985 | Regalbuto et al. | 166/297 |
| 4,693,181 | 9/1987 | Dadley et al. | 102/307 |
| 4,694,902 | 9/1987 | Hormansdorfer | 166/66 X |
| 4,708,204 | 11/1987 | Stroud | 166/65.1 X |
| 5,501,154 | 3/1996 | Rodney et al. | 102/331 |
| 5,582,248 | 12/1996 | Estes | 166/255.2 |

OTHER PUBLICATIONS

"Technical Data"; Author and Date Unknown; Accurate Arms Company, Inc.; McEwen, TN 37101.

"Owen Catalog"; Owen Oil Tools Inc.; Revised Apr. 22, 1986; Fort Worth, Texas 76140.

*Primary Examiner*—George A. Suchfield

*Attorney, Agent, or Firm*—Robert J. Harter

[57] ABSTRACT

A method of removing a pipe string anchored in cement within a wellbore involves the use of a coupling cutter having a linear charge that is magnetically oriented radially and rotationally within the pipe. The coupling cutter also has a coupling sensor that identifies the location of a coupling electronically. One first determines the free length of pipe that is above the cement. The coupling sensor then finds the lowest coupling that is just above the cement level so that the linear charge can be axially aligned to that coupling. A magnet on the cutter properly orients the linear charge both radially and rotationally relative to the inner wall of the pipe. The charge is detonated to longitudinally split the coupling. The pipe string is then disassembled and pulled from the wellbore.

10 Claims, 5 Drawing Sheets

METHOD OF LONGITUDINALLY SPLITTING A PIPE COUPLING WITHIN A WELLBORE

BACKGROUND OF THE INVENTION

1. Field of the Invention

The subject invention generally pertains to methods of removing pipe from a wellbore, and more specifically to explosively splitting a coupling longitudinally.

2. Description of Related Art

It is often desirable to sever, split or otherwise cut a string of tubing or casing to recover the pipe from an abandoned wellbore. In cutting pipe within a wellbore, pipe restrictions are often encountered. These restrictions may be in the form of a packer or fishing spear placed within the pipestring for the purpose of retrieval, or they may be of natural causes such as scale, paraffin, collapsed pipe, or smaller inner string of pipe stuck within the larger diameter pipe that is to be cut. Restrictions inhibit the use of present cutters that require a full opening or full inside diameter to achieve an effective cut. Other folding or spring-loaded devices have been developed to run through these restrictions, but these devices have met with little commercial success due to their mechanical complexity and high failure rate.

Over the years a variety of methods for cutting pipe in a wellbore have been developed. Some of these include chemical cuts, backoff shots, nitroglycerin, and various forms of shaped charges.

Chemical cuts are extraordinarily expensive and require the outer edge of the cutting device to be immediately adjacent (within a fraction of an inch) to the pipe being cut. By its design, the outer diameter of the chemical cutter head must be very close to the inside diameter of the pipe being cut. This limits the use of the chemical cutter in tubulars that have a restriction above the cutting point. Due to the "piston effect", the cutter floats into the hole, thereby slowing down the costly process of cutting and retrieving pipe from the ground.

Backoff shots are another way of separating the pipe within a wellbore. This process is simply placing an explosive device across a coupling and putting left-hand or reverse torque the string of pipe to be backed off. When the proper reverse torque is in the pipe, the explosive is discharged thereby creating shock waves at that point. The pipe then simply unscrews. The limitation of this method of pipe retrieval is that there is no guarantee as to where the pipe might unscrew.

The use of nitroglycerin is another method of severing the pipe at a coupling. This method, although simple and economical, simply blows up the tubulars and its immediate environment. Better said, it makes a mess of the pipe that is pulled and left in the ground. The use of nitroglycerin is not environmentally sound in that it prohibits or limits the reentering of this wellbore for future use.

There are various forms of radial-shaped charge in use and several of these products offer excellent cuts, however they have two inherent problems. As in the chemical cutter, the outside diameter of the radial cutter assembly must be very close to the target or inside diameter of the pipe being cut. This design limitation is due to the shaped charge design phenomenon of "standoff" whereby the distance between the charge and the target is crucial to its performance. Another resultant problem resulting from the large outside diameter of the cutter is that it has a "floating effect" as it is lowered into the hole. Additional weights are required to help push it into the hole. By-in-large though, the biggest drawback to the use of the radial charge is that it cannot be run through any significant restriction or constriction in the pipe. In other words, one must have a full opening from the surface to the required cutting depth.

The remaining option for cutting downhole tubulars is the use of the linear-shaped charge. As in the radial charge, the standoff phenomenon has dictated the design of various devices using the linear form of a shaped charge. Several of these devices use mechanical springs, unfolding charges or remotely extendible frameworks to properly position the charge with the proper design standoff against the coupling to be cut. Again, the complexity of such mechanisms have prooved to be unreliable and impractical when exposed to the severe pressures and temperatures of downhole environments.

BACKGROUND OF THE INVENTION

To avoid the problems and limitations of current methods of removing pipe from a wellbore, it is a primary object of the invention to provide a method of separating two pipes by destroying their coupling.

A second object is to provide a method that uses a cutter having no moveable parts.

A third object is to use a cutter whose diameter is less than half the inside diameter of the pipe line being separated, yet the cutter properly aligns itself against the inside wall of the pipe in both a radial and rotational direction.

A fourth object is to employ a magnet to establish a proper radial and rotational relationship of a linear-shaped cutter to the inside wall of a pipe.

A fifth object of the invention is to minimize damage to the pipe by longitudinally splitting the pipe line open with only a single slit through the pipe line at its coupling.

A sixth object is to provide an environmentally clean cut longitudinally across a coupling so that the casing left in the hole can be readily re-entered in the event that the well leaks and must be re-plugged or re-entered at a later date for additional production.

A seventh object is to rapidly lower a cutter through a wellbore at speeds generally unrestricted by obstacles or "piston effects".

These and other objects of the invention are provided by a novel method of disassembling a pipe from a well by lowering a linear charge into a well, sensing the location of a pipe coupling just above the cement, magnetically orienting the charge in a radial and rotational orientation relative to the inner wall of the pipe, axially aligning the charge to the coupling, detonating the charge to split the coupling longitudinally, and removing the pipe from the wellbore.

DESCRIPTION OF THE PREFERRED EMBODIMENT

Figure 1:
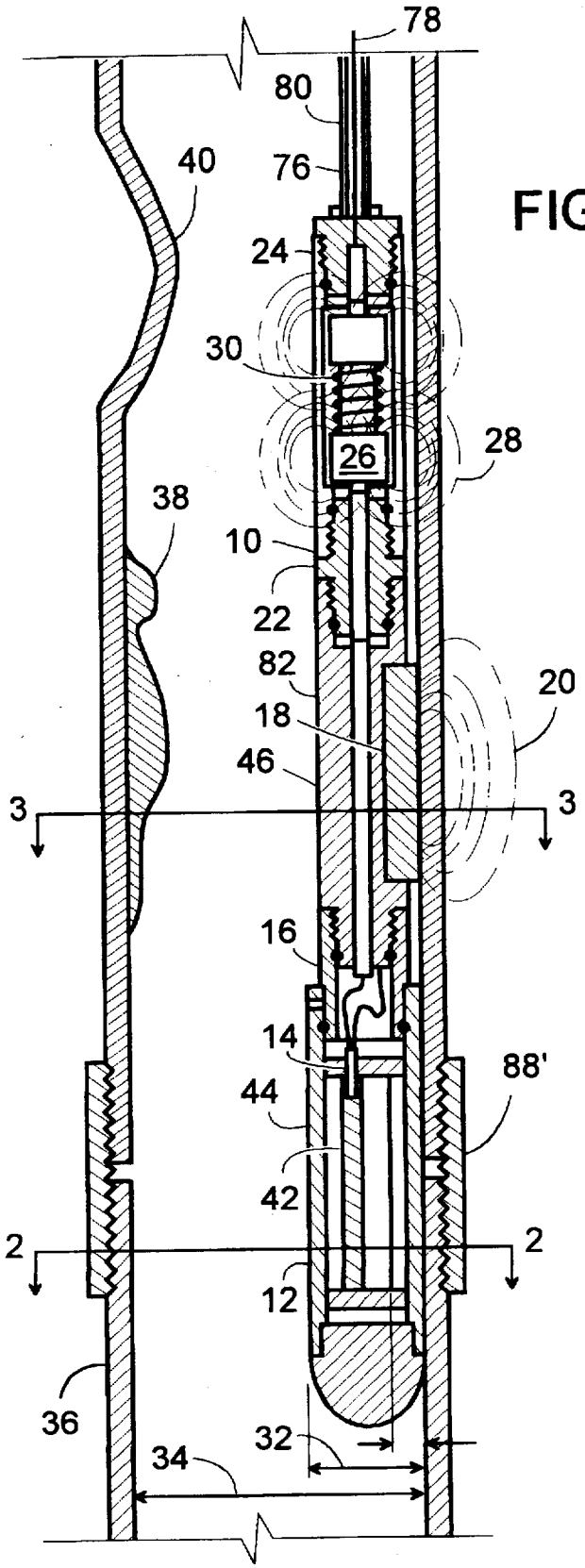
FIG. 1 is a cross-sectional view of a linear pipe coupling cutter.

A coupling cutter 10 of FIG. 1 includes a longitudinal charge assembly 12, an electrically ignitable cap 14, a first adapter 16, a first magnet 18 having a first magnetic field 20, a second adapter 22, and a coupling locator 24. Coupling locator 24 includes a second magnet 26 having a second magnetic field 28 extending across a coil 30. Cutter 10 has a major diameter 32 that is less than half of a nominal inside diameter 34 of a pipe 36, so that cutter 10 can readily travel through pipe 36 past various obstacles 38 and other restrictions 40 including, but not limited to, scale, paraffin, or collapsed pipe.

Figure 2:
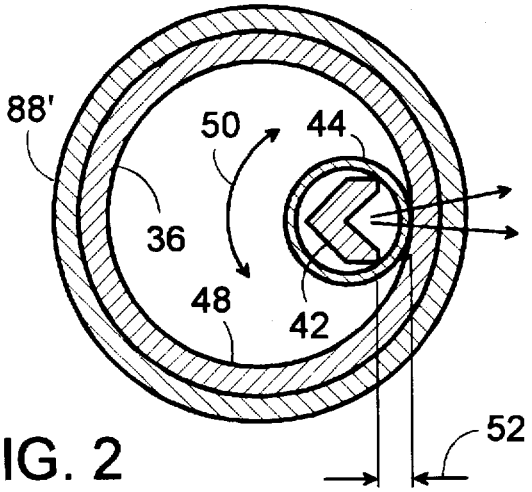
FIG. 2 is a cross-sectional view of the cutter taken along line 2—2 of FIG. 1.

A cross-sectional view of longitudinal charge assembly 12 is shown in FIG. 2. Longitudinal charge assembly 12 includes a longitudinal charge 42 contained within an aluminum housing 44. Housing 44, as well as all other external structural components 82 of cutter 10, must be able to withstand hydrostatic pressures exceeding 5,000 psi. The term "longitudinal charge" as used herein refers to an explosive charge whose length is greater than its width as opposed to "point" and "circumferential" shaped charges. Details of shaped charges, such as longitudinal charge 42, are explained in U.S. Pat. Nos. 5,501,154; 4,693,181; 2,587,244; 4,498,367; and 2,605,704 all of which are specifically incorporated by reference herein.

Figure 3:
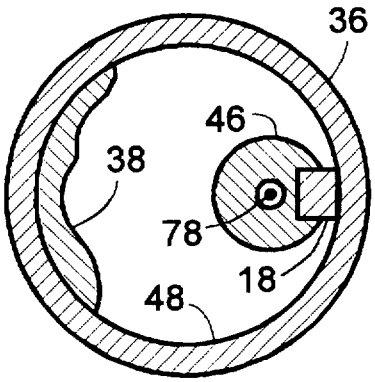
FIG. 3 is a cross-sectional view of the cutter taken along line 3—3 of FIG. 1.

A cross-sectional view of magnet 18 is shown in FIG. 3. Magnet 18 is a conventional magnet attached to a non-magnetic housing 46. Its magnetic field 20 is not strong enough to support the entire weight of cutter 10. If it were, it would prevent one from lowering cutter 10 down through pipe 36. Magnetic field 20 is, however, strong enough to draw coupling cutter 10 against an inner wall 48 of pipe 36. This establishes a proper rotational alignment 50 and radial alignment 52 of longitudinal charge 42 relative to inner wall 48, as shown in FIG. 2. The term "radial alignment" used herein is often referred to in the industry as "standoff" which is the critically important facial distance between the face of the charge and its target.

Figure 4:
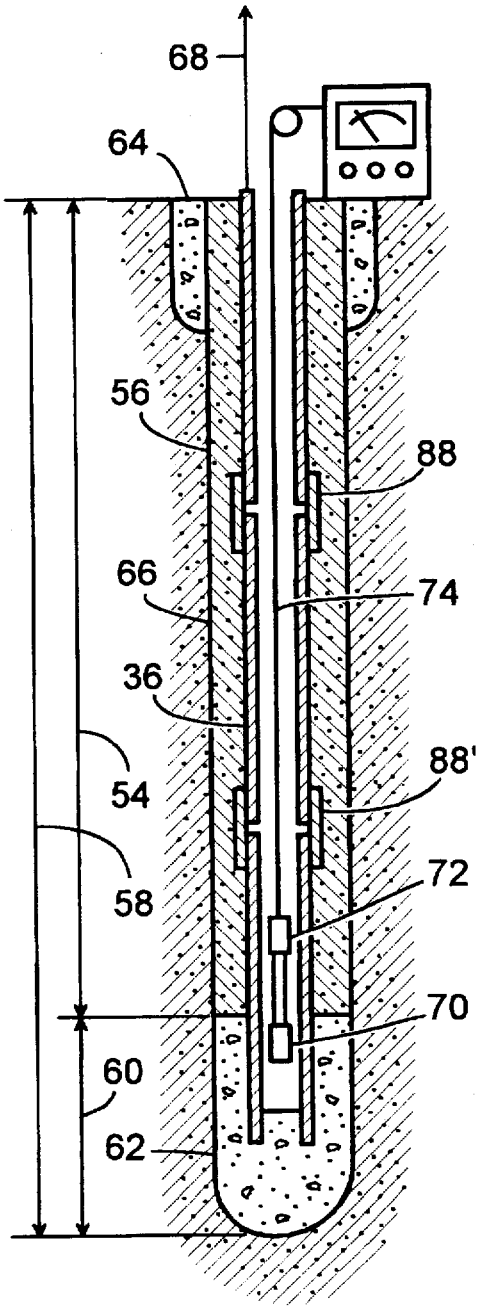
FIG. 4 shows the step of locating the cement depth.

Referring to FIG. 4, in operation, typically one first determines a cement depth 54 of a wellbore 56. In this example, wellbore 56 extends 10,000 feet deep 58 with 3,000 feet of its lower portion 60 set in cement 62. A surface pipe (not shown) is also cemented in place at an upper portion 64. Most of pipe 36 is surrounded by mud 66. Cement depth 54 can be determined several different ways. One can determine cement depth 54 by exerting an axial force 68 on pipe 36 and calculating the pipe length (above cement) as a function of the force, strain, and the pipe's modules of elasticity and cross-sectional area. Running a cement bond log is another common method of determining cement depth 54. This method involves lowering a 20 khz sound transmitter 70 and receiver 72 that provides an electrical feedback signal 74 that varies as a function of the sound dampening characteristics of the material surrounding pipe 36. Other methods consider the volume of cement 62 using volumetric calculations, or simply guess.

Figure 5:
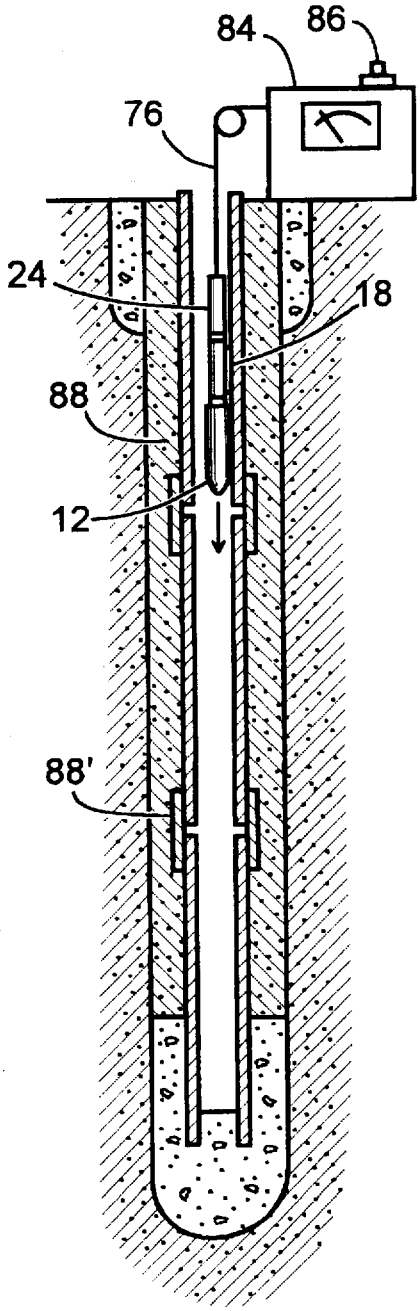
FIG. 5 shows the step of lowering the cutter into a wellbore.

Once cement depth 54 is determined, cutter 10 is lowered into pipe 36 by way of a two-conductor coaxial cable 76, as shown in FIGS. 1 and 5. One conductor 78 (center wire) is connected to one end of coil 30 and cap 14. Another conductor 80 (outer armor) is a ground connected to coil 30 and cap 14 via structural components 82 of cutter 10. Cable 76 suspends cutter 10, provides means for conveying current that ignites cap 14, and conveys a coupling location feedback signal to an instrument 84 (e.g., combination DC power supply and microampmeter). Instrument 84 senses the coupling location feedback signal and includes a switch 86 to ignite cap 14.

The coupling location feedback signal is an electrical signal induced through coil 30 upon magnetic field 28 being disturbed. Coupling locator 24 passing across a pipe coupling 88 causes the magnetic field disturbance.

Figure 6:
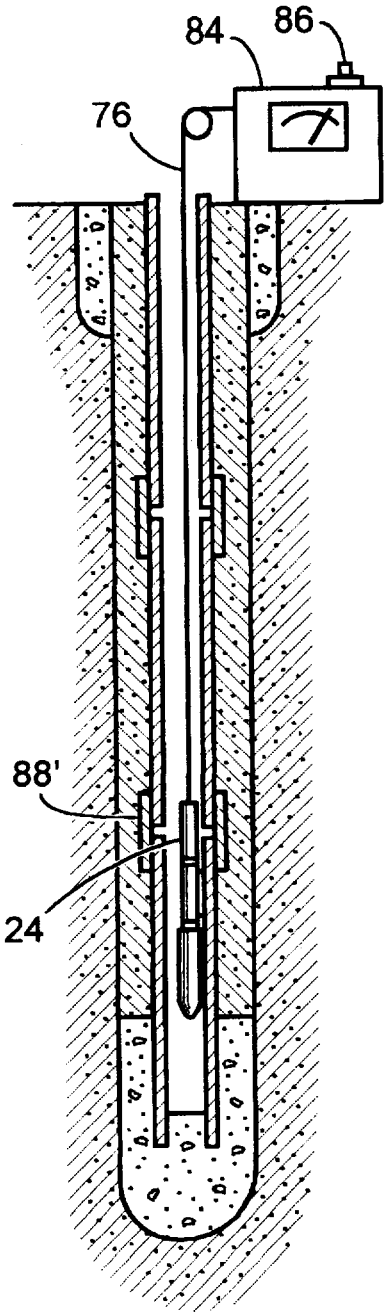
FIG. 6 shows the step of sensing the location of a pipe coupling.
Figure 7:
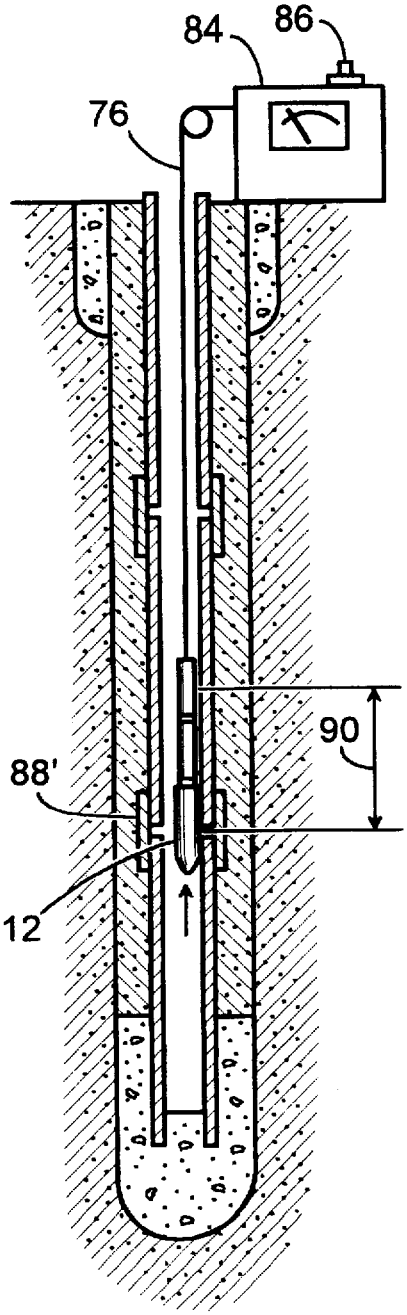
FIG. 7 shows the step of longitudinally cutting a pipe coupling.
Figure 8:
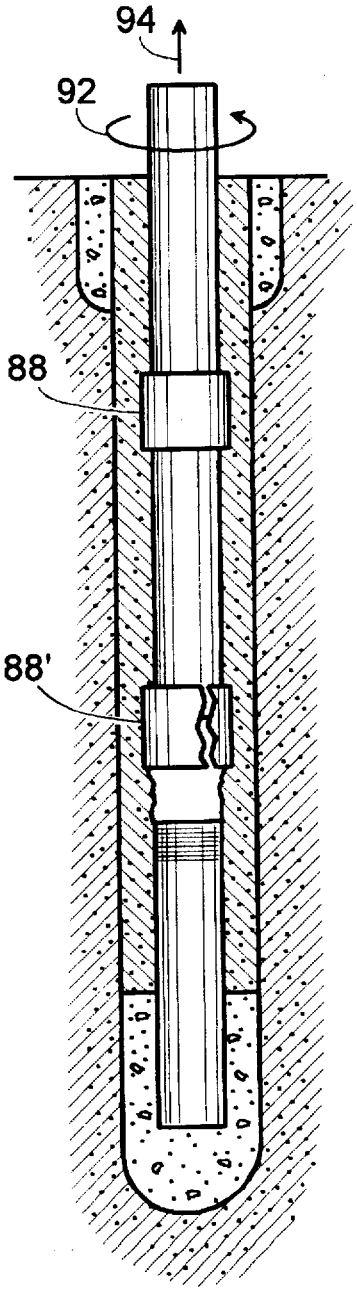
FIG. 8 shows the step of removing a string of pipes from a wellbore.

To identify the lowest coupling above cement depth 54, cutter 10 is first lowered to cement depth 54 and then raised while monitoring the coupling location feedback signal using instrument 84, as shown in FIG. 6. Once a coupling depth is identified, as indicated by the feedback signal reaching a predetermined limit, cutter 10 is then raised a distance 90 to longitudinally align charge 42 to coupling 88' as shown in FIG. 7. At this point an operator trips switch 86 to detonate charge 42. The explosion longitudinally splits coupling 88' (FIG. 8) so that pipes 36 are radially separated and removed as indicated by arrows 92 and 94, respectively.

Although the invention is described with respect to a preferred embodiment, modifications thereto will be apparent to those skilled in the art. Therefore, the scope of the invention is to be determined by reference to the claims which follow.

I claim:

1. A method of using a coupling cutter for splitting a coupling that joins two pipes that are buried in a wellbore, said coupling cutter comprising a longitudinal charge, an electrically ignitable cap adapted to detonate said longitudinal charge, a first magnet, a second magnet, and a coil in magnetic flux relationship with said second magnet; said method comprising the steps of:

lowering said coupling cutter longitudinally into said two pipes;

using a first magnetic field of said first magnet to magnetically draw said coupling cutter against an inner wall of said two pipes such that said longitudinal charge assumes a predetermined rotational and radial relationship relative to said inner wall of said two pipes;

disturbing a second magnetic field of said second magnet by passing said second magnet across said coupling during said step of lowering said coupling cutter;

inducing an electrical signal through said coil as a consequence of disturbing said second magnetic field;

monitoring said electrical signal;

identifying a coupling depth location of said coupling cutter at which said electrical signal reaches a predetermined limit;

moving said coupling cutter longitudinally a predetermined distance from said coupling depth location to longitudinally align said longitudinal charge to said coupling;

conveying an electrical current to said electrically ignitable cap to detonate said longitudinal charge, thereby exploding said longitudinal charge to longitudinally split and substantially destroy said coupling, whereby said two pipes are readily separable; and separating said two pipes at said coupling.

2. The method of claim 1, further comprising the step of identifying a cement depth location and wherein said coupling is identified as one being above said cement depth location.

3. The method of claim 1, further comprising the step of removing one of said two pipes from said wellbore.

4. The method of claim 1, wherein said two pipes have a nominal inside diameter and said coupling cutter has a major outside diameter that is less than half of said nominal inside diameter, whereby said coupling cutter can pass by a variety of obstacles and restrictions within said two pipes.

5. The method of claim 1, wherein said first magnetic field is of a magnitude that is insufficient to support the entire weight of said coupling cutter, whereby said coupling cutter can be lowered by its own weight through said two pipes.

6. A method of using a coupling cutter for splitting a coupling that joins two pipes that are buried in a wellbore, said coupling cutter comprising a longitudinal charge, an electrically ignitable cap adapted to detonate said longitudinal charge, a first magnet, a second magnet, and a coil in magnetic flux relationship with said second magnet; said method comprising the steps of:

lowering said coupling cutter longitudinally into said two pipes;

using a first magnetic field of said first magnet to magnetically draw said coupling cutter against an inner wall of said two pipes such that said longitudinal charge assumes a predetermined rotational and radial relationship relative to said inner wall of said two pipes;

disturbing a second magnetic field of said second magnet by passing said second magnet across said coupling during said step of lowering said coupling cutter;

inducing an electrical signal through said coil as a consequence of disturbing said second magnetic field;

monitoring said electrical signal;

identifying a coupling depth location of said coupling cutter at which said electrical signal reaches a predetermined limit;

moving said coupling cutter longitudinally a predetermined distance from said coupling depth location to longitudinally align said longitudinal charge to said coupling;

conveying an electrical current to said electrically ignitable cap to detonate said longitudinal charge, thereby exploding said longitudinal charge to longitudinally split and substantially destroy said coupling, whereby said two pipes are readily separable;

separating said two pipes at said coupling; and removing one of said two pipes from said wellbore.

7. The method of claim 6, further comprising the step of identifying a cement depth location and wherein said coupling is identified as one being above said cement depth location.

8. The method of claim 6, wherein said two pipes have a nominal inside diameter and said coupling cutter has a major outside diameter that is less than half of said nominal inside diameter, whereby said coupling cutter can pass by a variety of obstacles and restrictions within said two pipes.

9. The method of claim 6, wherein said first magnetic field is of a magnitude that is insufficient to support the entire weight of said coupling cutter, whereby said coupling cutter can be lowered by its own weight through said two pipes.

10. A method of using a coupling cutter for splitting a coupling that joins two pipes that are buried in a wellbore, said coupling cutter comprising a longitudinal charge, an electrically ignitable cap adapted to detonate said longitudinal charge, a first magnet, a second magnet, and a coil in magnetic flux relationship with said second magnet; said method comprising the steps of:

identifying a cement depth location with said coupling being above said cement depth location;

lowering said coupling cutter longitudinally into said two pipes, wherein said two pipes have a nominal inside diameter and said coupling cutter has a major outside diameter that is less than half of said nominal inside diameter, whereby said coupling cutter can pass by a variety of obstacles and restrictions within said two pipes;

using a first magnetic field of said first magnet to magnetically draw said coupling cutter against an inner wall of said two pipes such that said longitudinal charge assumes a predetermined rotational and radial relationship relative to said inner wall of said two pipes, said first magnetic field being of a magnitude that is insufficient to support the entire weight of said coupling cutter, whereby said coupling cutter can be lowered by its own weight through said two pipes;

disturbing a second magnetic field of said second magnet by passing said second magnet across said coupling during said step of lowering said coupling cutter;

inducing an electrical signal through said coil as a consequence of disturbing said second magnetic field;

monitoring said electrical signal;

identifying a coupling depth location of said coupling cutter at which said electrical signal reaches a predetermined limit;

moving said coupling cutter longitudinally a predetermined distance from said coupling depth location to longitudinally align said longitudinal charge to said coupling;

conveying an electrical current to said electrically ignitable cap to detonate said longitudinal charge, thereby exploding said longitudinal charge to longitudinally split and a substantially destroy said coupling, whereby said two pipes are readily separable;

separating said two pipes at said coupling; and removing one of said two pipes from said wellbore.

* * * * *